US006748780B1

(12) United States Patent
Luttgeharm

(10) Patent No.: US 6,748,780 B1
(45) Date of Patent: Jun. 15, 2004

(54) NUMERICALLY CONTROLLED FORMING METHOD

(75) Inventor: Clint Allen Luttgeharm, Wichita, KS (US)

(73) Assignee: D-J Engineering, Inc., Augusta, KS (US)

( * ) Notice: Subject to any disclaimer, the term of this patent is extended or adjusted under 35 U.S.C. 154(b) by 0 days.

(21) Appl. No.: 10/388,095

(22) Filed: Mar. 13, 2003

Related U.S. Application Data

(63) Continuation of application No. 09/838,637, filed on Apr. 19, 2001, now Pat. No. 6,532,786.
(60) Provisional application No. 60/198,316, filed on Apr. 19, 2000.

(51) Int. Cl.[7] ..... B21D 3/02
(52) U.S. Cl. ..... 72/115; 72/120; 72/124; 72/125
(58) Field of Search ..... 72/67, 82, 83, 72/112, 115, 120, 122, 124, 125

(56) References Cited

U.S. PATENT DOCUMENTS 1,788,382 A * 1/1931 Cushwa ..... 72/70
1,922,087 A * 8/1933 Hiester ..... 72/115
1,968,296 A * 7/1934 Hiester ..... 72/115
3,072,086 A * 1/1963 Birchfield et al. ..... 72/83
5,758,532 A * 6/1998 Massee ..... 72/83
6,561,002 B2 * 5/2003 Okada et al. ..... 72/115

* cited by examiner

*Primary Examiner*—Ed Tolan

(57) ABSTRACT

The present invention is a method for forming sheet material into contoured parts. The invention method includes these steps: A die is fashioned having an outside surface corresponding to the inside surface of the desired part. A plastically deformable sheet of material is clamped to the die so that the material is tangent to the die at a tangent area. A forming path is defined that follows the part's outside surface definition beginning at a point adjacent to the tangent area and tracing around the tangent area in circuits that incrementally offset away from the tangent area until all of the outside surface of the part is traced. A forming tool is then moved along the forming path so that the end of the forming tool presses the sheet material against the die thereby gradually forming the sheet material against the die to produce a finished formed part.

10 Claims, 8 Drawing Sheets

NUMERICALLY CONTROLLED FORMING METHOD

CROSS REFERENCE TO A RELATED APPLICATION

This application is a continuation of U.S. patent application Ser. No. 09/838,637 filed Apr. 19, 2001, now U.S. Pat. No. 6,532,786.

U.S. patent application Ser. No. 09/838,637 claimed the benefit of U.S. Provisional Patent Application No. 60/198,316 filed 19 April 2000.

FIELD OF THE INVENTION

This invention relates to a method and apparatus for forming a sheet of material about a forming die to produce a sheet material part having a desired shape.

BACKGROUND OF THE INVENTION

Numerous methods are known in the art for forming sheet material into complex contours and curved shapes. The working of sheet metal into complex or curved shapes is an area of art encompassing a great number of techniques some of which have been known to metal working artisans for centuries. More recently, processes have been developed to form sheet metal into complex shapes for a wide range of applications. The drop hammer process is used to press sheet metal between male and female dies to create contoured sheet metal parts. The Bag press forming process employs high pressure fluid to press a sheet metal workpiece against a die to produce a sheet metal part having a desired shape conforming to the die. Stretch forming is used to create contoured sheet metal parts such as aircraft skins by stretching sheet metal in relation to a male die until the sheet metal conforms to the desired contour. Explosive methods have been used to suddenly force sheet metal into a die with the pressure of an explosive charge. More recently, super plastic forming operations have been developed to form sheet metal into or over a die at high temperatures with a combination of gravity or the pressure of inert gas. All of these methods require specialized tooling and equipment.

Spinning is a very old sheet metal process for producing axially symmetric sheet metal parts. Spinning is illustrated in FIG. 1A and FIG. 1B. In the spinning process, a sheet metal workpiece is held in relation to a mandrel that defines the desired inside contour for the finished part. The outer surface of the mandrel is a surface of revolution. As can be seen in FIG. 1B, the part is formed by rotating both the mandrel and the sheet metal workpiece in unison while pressing the sheet metal against the mandrel with a forming tool. The path of the forming tool begins where the sheet metal workpiece is tangent to the mandrel and gradually proceeds along the mandrel until the sheet metal workpiece is formed to the mandrel. While the path of the forming tool relative to a fixed frame of reference is a simple curve in a plane, the path of the forming tool relative to the spinning mandrel and the workpiece is a spiral that traces the outside surface of the finished part. Spinning is a useful and effective process for producing parts defining a surface of revolution, however, spinning can not be used to shape parts that do not define a surface of revolution.

SUMMARY OF THE INVENTION

The present invention is a method for forming sheet material about a contoured die to produce a part having a contoured shape. In most applications, the invention method is used to form sheet metal. The invention method forms material in a manner similar to the ancient process of spinning. However, where spinning uses a rotating workpiece and a rotating axially symmetric die, the invention method uses a moving forming tool to press a stationary workpiece against a stationary die to produce a part that does not need to have a shape that is an axially symmetric figure of revolution. The invention method includes these steps: (1) A thin walled part is defined to have a shape bounded by an inside surface and the outside surface. (2) A rigid die is fashioned having a forming surface corresponding to either the inside surface or the outside surface of the part. (3) A suitable sheet of workpiece material is held in a fixed relation to the die so that the material is tangent to the die at a tangent area. (3) A forming path is defined that follows the surface definition of the part that is opposite from the surface used to define the die. The forming path begins at a point adjacent to the tangent area and traces around the tangent area in circuits that incrementally offset away from the tangent area until all of the surface of the part is traced. (4) A forming tool is then moved along the forming path so that the contact surface of the forming tool presses the sheet material against the die thus gradually forming the sheet material to the shape of the die. When the forming tool reaches the end of the forming path, the sheet material is completely formed against the die and has taken on the desired shape of the finished part.

A digital computer can be used to define the inside and outside surfaces of the part and a digital computer can also be used to define the forming path. With such digital definition, it is possible to fashion a die using well known numerically controlled machining methods. By using a numerically controlled machine, it is also possible, using known methods, to move the contact surface of a forming tool along a forming path as described above. Accordingly, the invention process can be performed where digital part definitions and numerically controlled machines are available. Unlike with processes that rely on drop hammers and hydro-presses, with the invention method only a small amount of energy is used to form a workpiece at any one time so that forming dies for the invention process do not have to be made of strong materials that can withstand very large forces. Consequently, lighter, low cost and easily workable materials such as laminated wood can be used to fashion a forming die for the invention method. Moreover, only a single die is needed to make a contoured sheet metal part using the invention method. The invention method can be used to produce parts that would otherwise require the use of expensive specialized hammer mills and hydrodynamic presses. Because the invention method exploits widely available digital definition technology and uses standard numerically controlled machinery, it is now possible to make contoured sheet metal parts where they could not be previously made. With the invention forming process, it is also now possible to make such parts in small quantities where before the non-recurring costs of making small quantities in terms of machinery and tooling would have made it too expensive to produce such small quantities.

BRIEF DESCRIPTION OF THE DRAWINGS

The invention and its many attendant objects and advantages will become better understood upon reading the following description of the preferred embodiment in conjunction with the following drawings, wherein.

DETAILED DESCRIPTION OF THE INVENTION

Prior Art

Figure 1A:
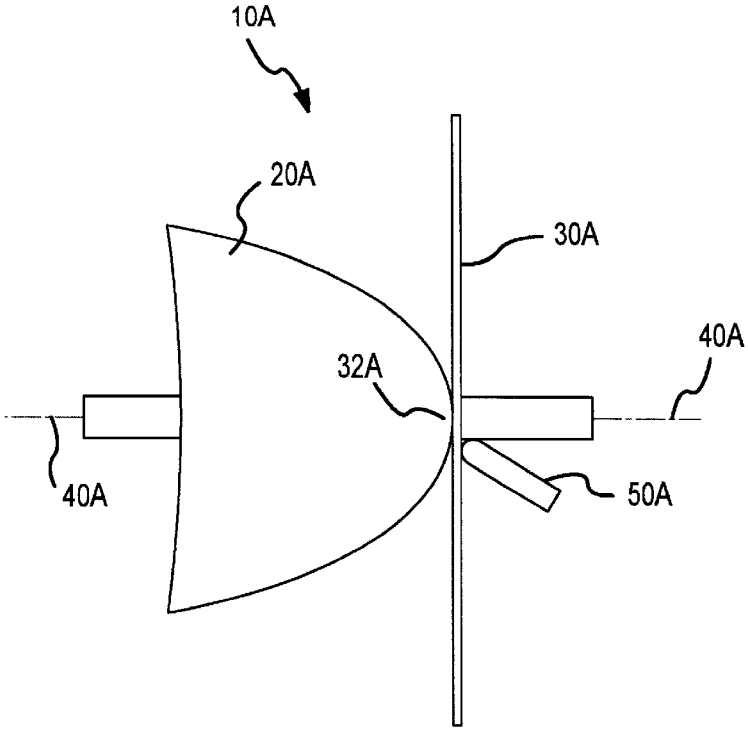
FIG.1A PRIOR ART
FIG. 1A is a side view of a sheet of material prior to being formed using the process of spinning.
Figure 1B:
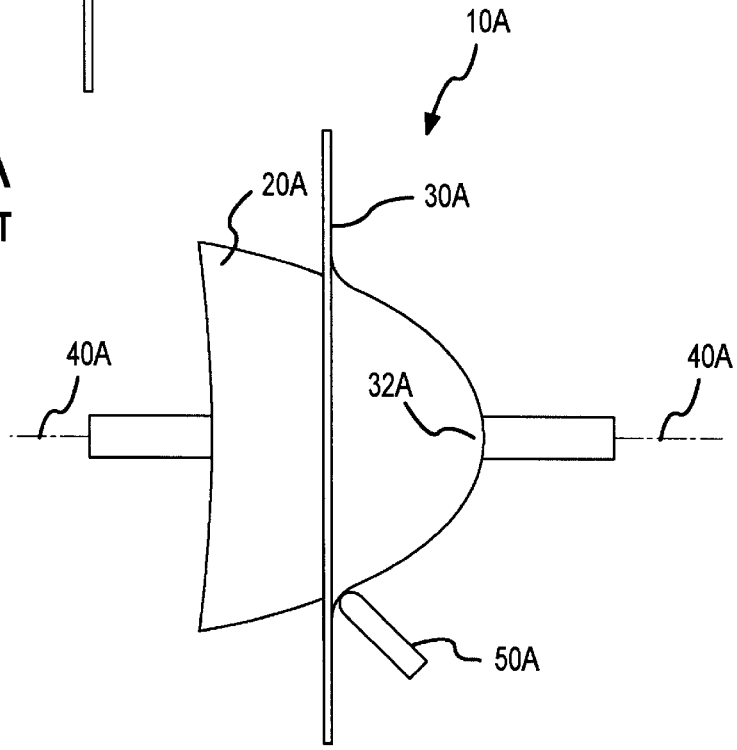
FIG.1B PRIOR ART
FIG. 1B is a side view of a sheet of material being formed using the process of spinning.

FIG. 1A and FIG. 1B illustrate the prior art process of spinning. In FIG. 1A and FIG. 1B, workpiece 30A is held in a fixed position relative to mandrel 20A so that workpiece 30A is pressed to mandrel 20A at tangent area 32A. Mandrel 20A and workpiece 30 are rotated about axis 40A while forming tool 50A travels from a first position adjacent to tangent area 32A as shown in FIG. 1A to a second position as shown in FIG. 1B. As forming tool 50A travels along the surface of rotating workpiece 30A, workpiece 30A is deformed against rotating mandrel 20A until the inside surface of workpiece 30A takes on the shape of the outside surface of mandrel 20A to complete a finished part.

In the prior art process of spinning, mandrel 20A has an outer surface that is a surface of revolution. Because the outer surface of mandrel 20A is a surface of revolution, forming tool 50A can be moved along a simple arc shaped path is it deforms workpiece 30A into a shape that conforms to mandrel 20A. Since spinning is not a frictional process, measures are taken to reduce friction between forming tool 50A and workpiece 30A. Dissimilar materials are selected for forming tool 50A and workpiece 30A in order to reduce friction. If aluminum is being spun, then steel is selected for the forming tool. If steel is being spun, brass is selected for the forming tool. The surface of workpiece 30A that comes in contact with forming tool 50A is lubricated to further reduce the chance that forming tool 50A will grab and tear sheet metal workpiece 30A.

Invention Forming Method

Figure 2:
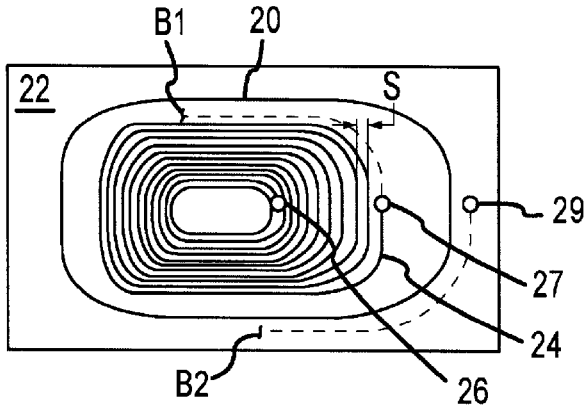
FIG. 2 is a top view of a forming die for use in the invention process with a superimposed forming path.

FIG. 2, FIG. 2A, FIG. 2B, FIG. 2C and FIG. 2D illustrate the invention forming process. FIG. 2 provides a top view of a forming die 20 fixed to a base 22. The outer surface of forming die 20 shown in FIG. 2 does not describe a surface of revolution as does mandrel 20A in FIG. 1A and FIG. 1B. However, the shape described by the outer surface of forming die 20 shown in FIG. 2 is a shape that might be easier to form with the invention process than other more complex and drastically contoured shapes because it would be topographically closer to a surface of revolution than those other more complex and more drastically contoured shapes. A forming path 24 is also shown superimposed upon forming die 20 in FIG. 2. Forming path 24 is a curve in space that begins at a starting point 26 and proceeds in a spiraling fashion by a series of concentric passes around and down a surface that is offset from the surface of forming die 20 until it reaches an end point 29. Not all of forming path 24 is shown in FIG. 2. Break marks B1 and B2 indicate an interruption that has been placed in forming path 24 as illustrated to improve the clarity of FIG. 2. Accordingly, the reader should understand that forming path 24 continues in a spiraling fashion between break marks B1 and B2. Forming path 24 continues from break mark B2 to an end point 29. The amount by which forming path 24 is offset from the surface of forming die 20 will be explained in greater detail below. Each pass of forming path 24 is separated from the previous pass by a pass spacing distance S indicated in FIG. 2. Point 27 shown in FIG. 2 indicates a center point of a forming tool which will be described in more detail below.

Figure 2A:
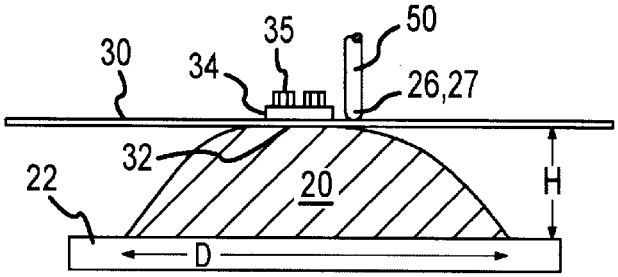
FIG. 2A is a sectional side view of a sheet of material clamped to a forming die prior to being formed using the invention forming method.
Figure 2B:
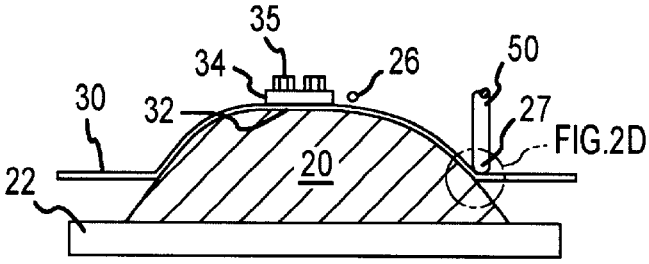
FIG. 2B is a sectional side view of a sheet of material being formed using the invention forming method.
Figure 2C:
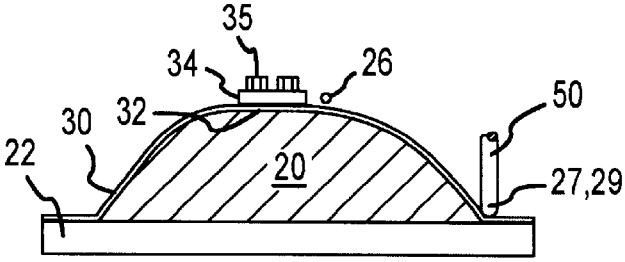
FIG. 2C is a sectional side view of a sheet of material that has been completely formed using the invention forming method.

In FIG. 2A, FIG. 2B and FIG. 2C, a workpiece 30 is held in a fixed position relative to forming die 20 at a tangent area 32 by a plate 34. Plate 34 can be bolted to the body of forming die 20 by bolts 35 as shown or can be clamped to forming die 20 by some other means. Tangent area 32 is the top, flat surface of forming die 20 where workpiece 30 may can lay flat. In FIG. 2A, a forming tool 50 is situated at the edge of tangent area 32 at starting point 26.

The diameter D and the height H of forming die 20 is indicated in FIG. 2A. When the ratio of height H to diameter D is between approximately 1/4 to 1/1, a part will be relatively easy to form using the invention method. Where this ratio is very low, the part has a subtle curvature and spring back may cause the part to deform when it is removed from the die. When this ratio is very high, large amounts of deformation are needed to make the part which may cause tearing to occur. Accordingly, parts of moderate height in relation to their diameters and parts that are topographically closer to a surface of revolution will be parts that are most easily formed using the invention method. If a part shape is topographically very dissimilar from a surface of revolution, it may be possible that the part shape could be produced as part of an larger shape that is topographically closer to a surface of revolution. The invention method can be used to form the larger shape from which the smaller shape may be removed.

Forming tool 50 is a ball pointed stylus which should be fashioned from a strong material that is different from material of workpiece 30. The center point of the spherical end of forming tool 50 is indicated by a tool center point 27 which in FIG. 2A is coincident with starting point 26. Forming tool 50 is preferably mounted in the spindle of a numerically controlled milling machine (not shown) which is able to hold the position of forming tool 50 against significant pressure and which is capable of smooth motion in at least three directions. Preferably, forming tool 50 should be mounted so that it may freely rotate about its own axis. The applicant has found that a steel forming tool works best when forming aluminum workpieces and that a brass forming tool works best when forming sheet steel. As with the ancient spinning process, the surface of workpiece 30 should be lubricated when using a ball point stylus. Also, as would be readily understood by those skilled in the art, the surface of workpiece 30 that comes in contact with forming tool 50 should be free of scratches and other irregularities that might provide a starting point for a crack.

In FIG. 2B, workpiece 30 is shown in cross section and is shown partially formed. Forming tool 50 is situated at a second position more distant from the edge of tangent area 32. The exact position of forming tool 50 can be determined by the location of center point 27. In this example, forming tool 50 is held in a vertical position to reduce the complexity of the numerically controlled machine operations that must be performed as its center point 27 is moved along forming path 24 shown in FIG. 2.

FIG. 2C shows workpiece 30 after it has been formed against the outside surface of forming die 30. In FIG. 2C, forming tool 50 is positioned so that center point 27 of forming tool 50 and end point 29 of forming path 24 coincide. At this stage, forming tool 50 can be moved away from workpiece 30 and workpiece 30 can be removed from forming die 20 for further processing.

Figure 2D:
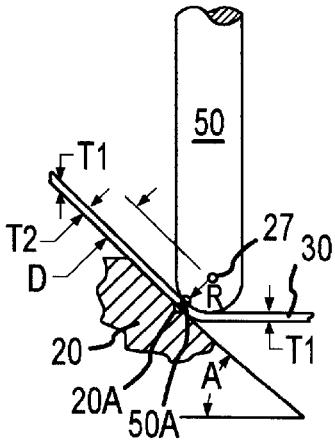
FIG. 2D is a close up view of a sheet of material being formed taken from area D indicated in FIG. 2B.

The position of forming tool 50 and its center point 27 as well as the thickness of workpiece 30 after forming is better understood by referring to FIG. 2D which is taken from FIG. 2B. In FIG. 2D, workpiece 30 has a thickness T1 prior to forming. However, after forming in what is essentially a shear forming process, workpiece 30 has a thickness T2 which is less than T1. This is because the dominant forming mode of the process as shown in this example is shear forming wherein the thickness of the workpiece in the vertical direction stays constant. Forming tool 50 does not frictionally engage the surface of workpiece 30—it either rolls or slides across the lubricated surface of workpiece 30 as it forms the material of workpiece 30. The process as shown in this example effects the material of the workpiece in a manner that is similar to a spinning process where the thickness of the material is being reduced. If forming tool 50 were to be pressed against workpiece 30 with significantly more pressure in a forceful rolling action so as to further thin the material of workpiece 30 thereby further reducing T2, then the effects of the process would be more like the well know stretch forming process where sheet material is stretched over a contoured die.

After forming in the shear forming process shown in this example, the thickness of workpiece 30 in the vertical direction is T1. However, the actual thickness of workpiece 30 in a normal direction is now T2. Thickness T2 is related to angle A which is the angle at which workpiece 30 is being formed. More particularly, angle A is the local angle between the workpiece surface as formed and the workpiece surface prior to being formed. As angle A increases, T2 decreases. Thickness T2 can be approximated by the following equation: T2=Cos. A×T1. As can also be seen in FIG. 2D, forming tool 50 has a ball point with a radius R. Once thickness T2 is known, it is possible to determine the offset distance between a point 20A on the surface of die 20 and center point 27. This offset distance is indicated in FIG. 2D as distance D. That offset distance D would be given by the equations: D=T2+R., or D=(Cos. A×T1)+R. If an offset distance D can be calculated for every point on the surface of die 20, then a offset surface can be determined that is offset from the surface of die 20. A forming path such as forming path 24 that lies on that offset surface will give the path that center point 27 of forming tool 50 should follow to form workpiece 30.

In the alternative, a forming path can be laid out on a surface defined by a multitude of points such as point 50A shown in FIG. 2D. Point 50A is the contact point which is at the center of a small contact surface between forming tool 50 and workpiece 30. The exact location of point 50A could be determined by finding corresponding point 20A on the surface of forming die 20 and offsetting normal from the surface of forming die 20 by a distance equal to T2 or by a distance that is approximately equal to T2. Many numerically controlled machines rely on tool path data sets that are based on contact points instead of tool center points. By decreasing the offset distance between the surface of forming die 20 and contact point 50A, a forming path can be established that causes workpiece 30 to be further thinned.

The above described methods for defining an offset surface that compensates for localized thinning of a workpiece are methods for defining an ideal forming path. However, even with present computer technology, the calculations for determining such an ideal forming path can require significant computer processing time. Accordingly, a forming path might be more easily described on an offset surface that is merely spaced from the forming die surface by a distance corresponding to the sum of the expected average part thickness and the forming tool radius. A step closer to an ideal forming path would be to define zones on the offset surface where different workpiece thickness values are used depending on an estimated average forming angle in each zone. Depending on the application, a less than ideal forming path may be used to produce an acceptable part.

One technique for defining a forming path similar to forming path 24 shown in FIG. 2 would be to intersect a set of descending planes with the offset surface such as described above to define a series of passes that could comprise a forming path. A first plane would a be a plane that is offset by the appropriate offset distance from tangent area 32. The rest of the planes in the set would progressively intersect the offset surface to define the series of concentric passes. The concentric passes could then be linked together to define a complete forming path.

The spacing of passes as indicated in FIG. 2 by the reference character S is also a parameter that should be changed with changing conditions. Generally, pass spacing, S will increase with thickness T of workpiece 30. S, the pass spacing value, for most materials, should fall somewhere between workpiece thickness T and radius R of forming tool 50. However, as angle A shown in FIG. 2D decreases below an optimum angle of approximately 45 degrees, pass spacing S should be decreased to reduce spring back. Spring back occurs more readily on more subtly contoured surfaces. However, as angle A increases above an angle of approximately 45 degrees, pass spacing should again be decreased to reduce the tearing that might occur as a result of the large amounts of material deformation that would occur with a larger pass spacing value.

The above description relies on FIG. 2, FIG. 2A, FIG. 2B, FIG. 2C and FIG. 2D which illustrate an example where a three axis, numerically controlled machine is used to drive one forming tool. A five axis, numerically controlled machine could be used to manipulate the angle of forming tool 50 in relation to the surface of forming die 20. If forming tool 50 is mounted in a freely rotating spindle, then forming tool 50 can be manipulated so that it rolls as it moves across the surface of the workpiece. It may also be possible to construct a three or five axis machine capable of independently driving more than one forming tool. The simultaneous use of more than one forming tool could significantly enhance the forming process.

In FIG. 2B, the unformed portions of workpiece 30 are shown in an idealized manner as having a straight or flat shape. In practice, the unformed portions of workpiece 30 would become deformed and take on an irregular concave shape as the part is formed. As the shape of forming die 20 is more dissimilar from a surface of revolution, the more the unformed portions of workpiece 30 will bend up and away from base 22 in an irregular and uncontrolled manner. One technique for counteracting the tendency of unformed material to bend up in an irregular fashion is to clamp reinforcing stiffeners around the periphery of a workpiece such as workpiece 30. This will make it possible to form the sheet material in a more controlled fashion.

Multiple forming passes can be used in the process shown in FIG. 2, FIG. 2A, FIG. 2B and FIG. 2C to reduce spring back. Spring back is a common problem that occurs in almost all sheet metal forming processes. One technique for reducing spring back is to repeat at least a portion of the forming path. For example, the portion of the forming path prior to the position shown in FIG. 2B could be repeated after the execution of the entire forming path and then the entire forming path could be repeated. Assuming that approximately 50% of the forming path occurs prior to the position shown in FIG. 2B, the total distance traveled by forming tool 50 would approximately triple if the above described repeat steps were performed.

The process illustrated in FIG. 2, FIG. 2A, FIG. 2B, FIG. 2C and FIG. 2D is intended to describe the best mode for practicing the method of the present invention. The invention process is best practiced when the workpiece is made from a material that is relatively malleable. For example, aluminum alloys in an annealed condition such as 6061-O or 2024-O are most easy to form using this process. Heat treated aluminum alloys such as 2024-T3 or 7075-T6 are more difficult to form using this process.

The radius R of forming tool 50 determines the bending radius of the material of workpiece 30 as it is being formed. If radius R is too small relative to the thickness of the material of workpiece 30, cracks will develop in the surface of workpiece 30 as it is being formed by forming tool 50. Generally, an acceptable bend radius for forming annealed aluminum alloys such as 2024-O is approximately twice the thickness of the material. Radius R of forming tool 50 should be above the acceptable bend radius of the material of workpiece 30.

Figure 3A:
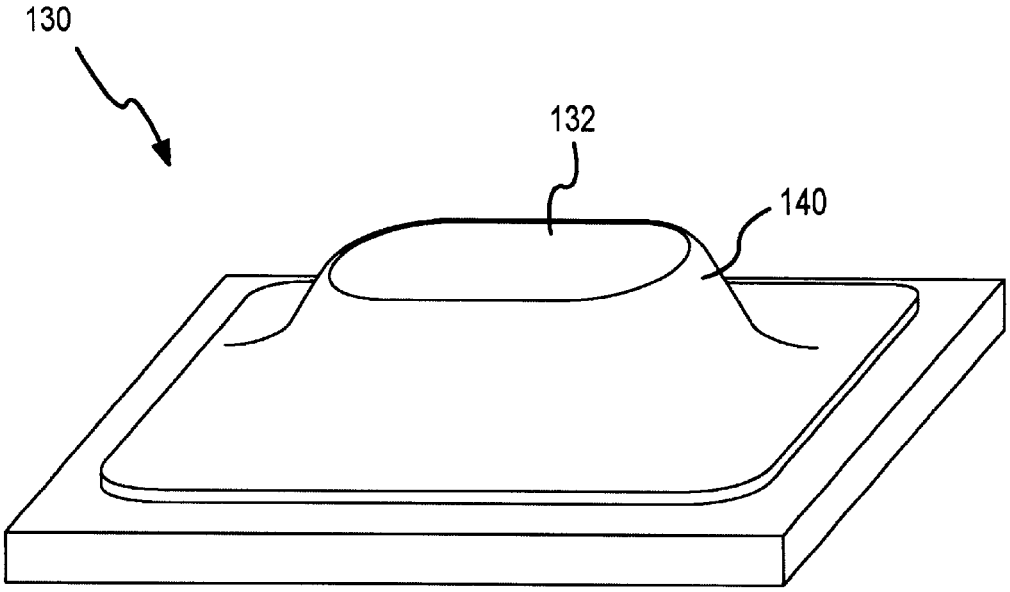
FIG. 3A is a perspective view of a part of the type that can be easily made using the invention method.
Figure 3B:
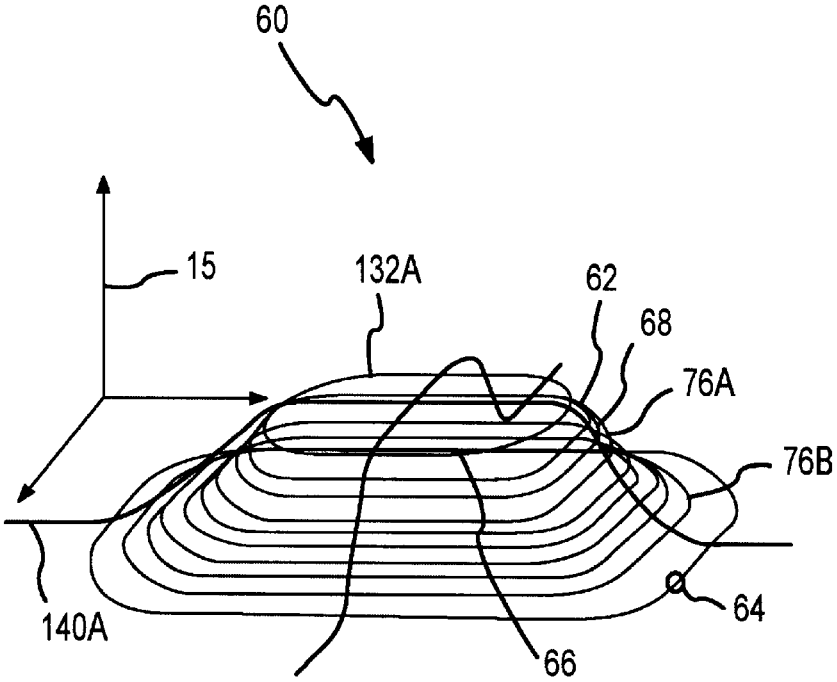
FIG. 3B is a perspective view of a forming path used by the invention forming method to form a the part shown in FIG. 3A.

FIG. 3A and FIG. 3B further illustrate the method of the present invention using three dimensional views. FIG. 3A provides a three dimensional view of a finished part 130. Finished part 130 has an outer surface 140 which includes a tangent area 132. FIG. 3B provides a three dimensional view in relation to axis system 15 showing a forming path 60 that is described upon a surface 140A. Surface 140A is a computer generated surface that corresponds to outside surface 140 of finished part 130. Surface 140A also includes a tangent area 132A that corresponds to tangent area 132 of finished part 130. Forming path 60 begins at a starting point 62 at the edge of tangent area 132A and ends at an endpoint 64. Forming path 60 is a three dimensional continuous curve that lies on surface 140A. In this example, forming path 60 is placed directly on surface 140A because some numerically controlled machines use the tool contact point as the basis for a tool path. Such systems will convert contact points into tool center points by an using an offset value equal to the radius of the tool and by also using vectors normal to the workpiece surface. Accordingly, forming path 60 describes the path traveled by the contact point of a forming tool as the forming tool works a sheet of material into a finished part shaped like finished part 130.

As can be seen in FIG. 3B, forming path 60 comprises a multitude of circuits. Each of these circuits can be defined in a plane that is parallel to the plane of tangent area 132A. A first circuit 66 begins at starting point 62 and orbits tangent area 132A until reaching offset point 68. At offset point 68, forming path 60 is translated in an incremental stepwise a position to the beginning of a second circuit that lies on surface 140A. The remaining circuits are disposed at incrementally greater distances from tangent area 132A upon surface 140A. If all of the circuits are traced from staring point 62 to end point 64, all of surface 140A is traveled with the exception of tangent area 132A.

The invention forming method for producing a part such as part 140 shown in FIG. 3A would include the following steps: (1) Define a shape for finished part 130 having an outside surface 140. The definition of the finished part is bounded by an inside surface and an outside surface such as outside surface 140 of FIG. 3A. (2) Define the outside surface of a forming die using the definition of the inside surface of the part and make a die that conforms to that definition. (3) Define a forming path such as forming path 60 shown in FIG. 3B. The forming path must follow the outside surface of the shape in a progressive, incremental fashion as shown in FIG. 2B. This is done by first selecting a tangent area such as tangent area 132A shown in FIG. 3B and then defining the forming path so that its first circuit orbits the tangent area and so that each next circuit incrementally offsets away from the tangent area until the entire outside surface of the part has been traced by the forming path. (4) Select a sheet of material having a thickness slightly greater that the desired thickness of the part and a size that easily encompasses the surface area of the desired finished part. A thin sheet of metal such as annealed aluminum or copper would respond well to the invention forming process. (5) Secure the sheet of material to the forming die by clamping the sheet of material to the die at a place that corresponds to the tangent area. (6) Obtain a forming tool having a contact surface such as forming tool 50 shown in FIG. 2D. (7) Orient the forming path in relation to the forming die and move the forming tool so that its contact surface follows the forming path to cause the material to deform to the shape of the die. (8) Remove the formed part from the die. The same method can also be practiced to make a part on a female forming die by using a forming die having a forming surface corresponding to the outside surface of a contoured part and by using a forming path that traces the inside surface of the part.

An additional step may be added to the above process to reduce spring back. In this additional step, the forming tool may be moved around circuit 76A shown in FIG. 3B and then also possibly around circuit 76B prior to the execution of all of the circuits of the forming path including circuits 76A and 76B. This causes the workpiece to be approximately formed around the forming die so that less spring back will occur when the workpiece is completely formed. The dominant mode of this initial forming process is a flexure mode where the workpiece maintains a constant thickness. The mechanical effects of this flexure process would be similar to brake press or bag press forming.

FIG. 4A, FIG. 4B, FIG. 4C, FIG. 4D and FIG. 4E illustrate various forming tools that can be used to execute the forming process of the invention forming method. FIG.

Figure 4A:
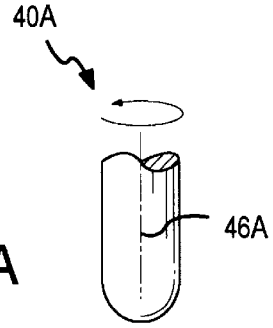
FIG. 4A is a side view of a ball nose forming tool.
Figure 4B:
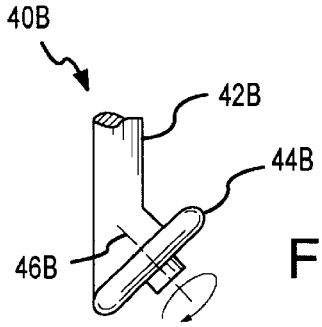
FIG. 4B is a side view of an inclined wheel forming tool.
Figure 4C:
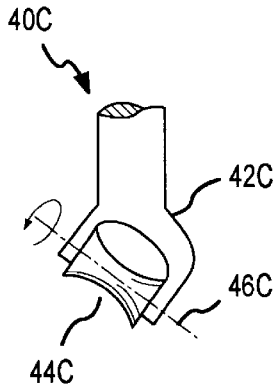
FIG. 4C is a side view of an inclined corner forming tool.
Figure 4D:
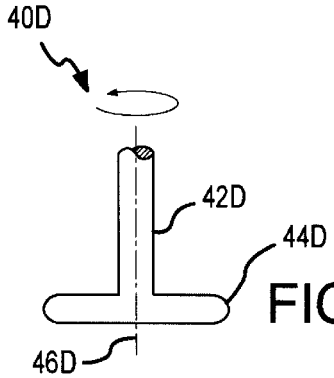
FIG. 4D is a side view of a flywheel forming tool.
Figure 4E:
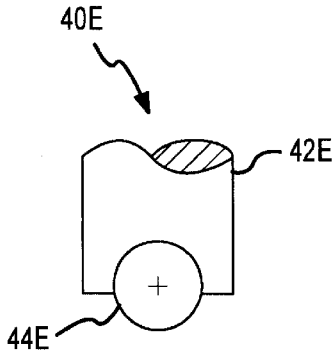
FIG. 4E is a side view of a spherical forming tool.

4A illustrates a bull nose tool 40A that is adapted to rotate about an axis 46A. FIG. 4A shows an inclined wheel tool 40B that includes a wheel 44B that can rotate on an axis 46B in relation to a fixed stylus 42B. Inclined wheel tool 40B might be used to follow a forming path on a part having a recessed surface. FIG. 4C shows a recessed wheel tool 40C that includes a stylus 42C and a recessed wheel 44C that can rotate about axis 46C in relation to stylus 42C. Recessed Wheel tool 40C can be used to fashion a male corner. FIG. 4D illustrates a flywheel tool 40D having a shaft portion 42D and a rounded wheel portion 44D. Flywheel tool 40D can rotate about axis 46D. FIG. 4E illustrates a rolling spherical tool 40E including body 42E and roller 44E.

Figure 5A:
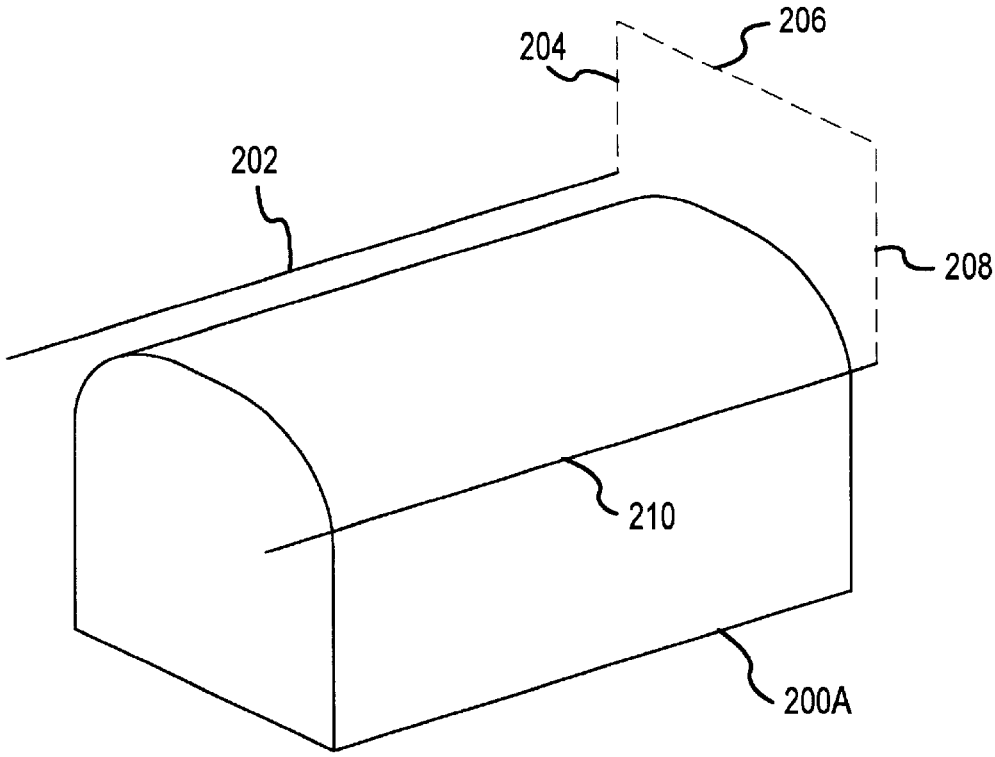
FIG. 5A is a perspective view of a contoured part and a discontinuous forming path.
Figure 5B:
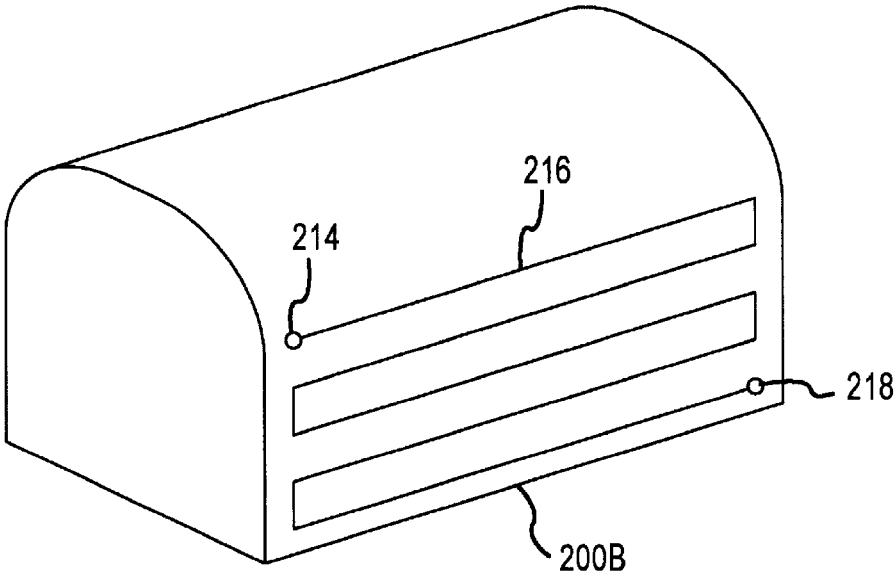
FIG. 5B is a perspective view of a contoured part and a forming path.

With the use of various forming tools as illustrated in FIG. 4A, FIG. 4B, FIG. 4C, FIG. 4D and FIG. 4E, discontinuous forming paths can be employed to form parts having complex shapes. A discontinuous forming path is shown in FIG. 5A. The forming path shown in FIG. 5A includes a first path 202 where the forming tool (not shown) is in contact with the workpiece surface, a second, third and fourth path 204, 206 and 208 where the forming tool is out of contact with the workpiece surface and a fifth path 210 where the forming tool is again in contact with the workpiece surface. The forming path shown in FIG. 5A may be repeated in an incremental fashion until the side surfaces of the shape shown in FIG. 5A have been formed. FIG. 5B illustrates a forming path 216 for forming the side of workpiece 200B. Forming path 216 begins with starting point 214, continues through the convolutions of forming path 216 and ends with end point 218.

Figure 6:
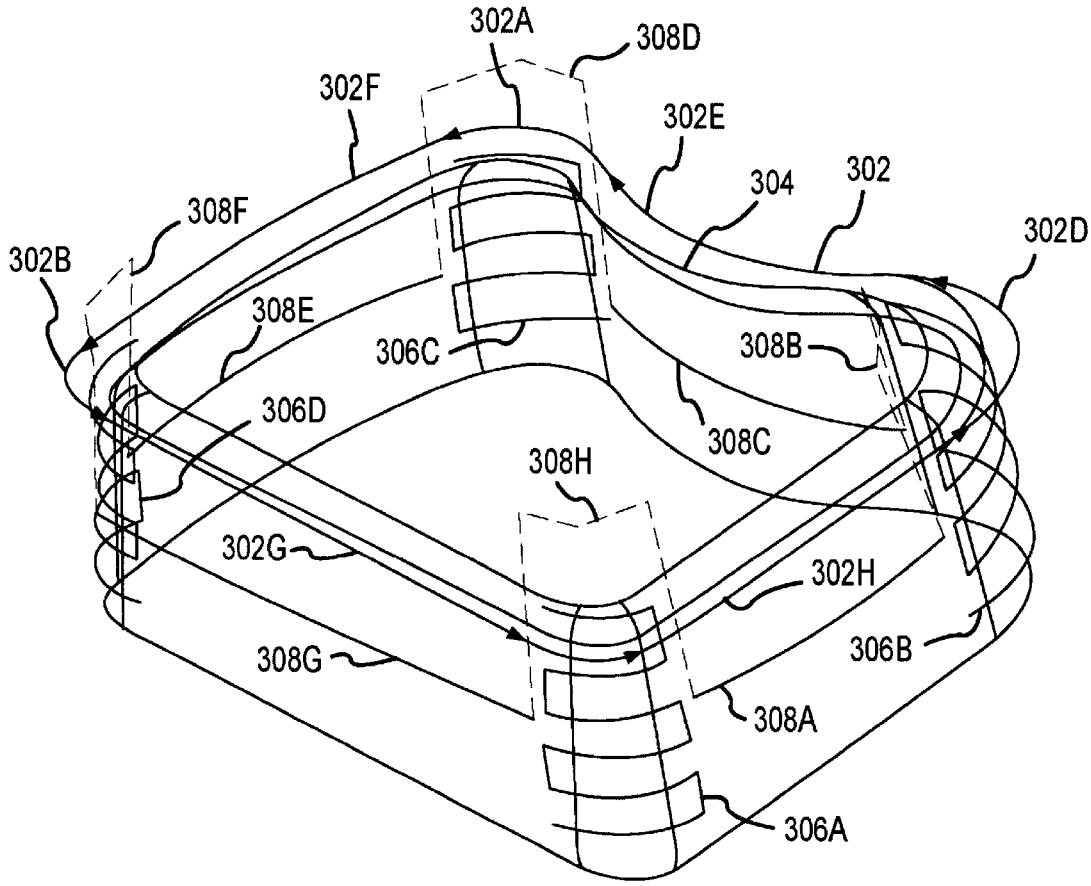
FIG. 6 is a perspective view of a contoured part and a plurality of forming paths.

The use of various types of forming paths to form a complex contoured part 300 is shown in FIG. 6. A discontinuous forming path 302 for forming the top fillets and comer fillets of the part includes alternating forming path segments 302A, 302B, 302C, 302D, 302E, 302F, 302G and 302H. Segments 302A, 302B, 302C and 302D are corner fillet forming path segments where corner surfaces are formed. Segments 302E, 302F, 302G and 302H are fillet surfaces where portions of the fillets are formed. Segments 302A, 302B, 302C and 302D could, for example, be traced first using one type of forming tool and then segments 302E, 302F, 302G and 302H could be traced using a different type of forming tool. All of these segments may have different forming requirements and may involve the use of a variety of tools as are shown in FIG. 4A through FIG. 4E. This set of alternating path segments including segments 302A, 302B, 302C, 302D, 302E, 302F, 302G and 302H shown in FIG. 6, is just one set of a large number of sets of forming path segments that would be incrementally placed upon the various surfaces of part 300. All of these alternating segments would be incrementally traced many times as the various surfaces are gradually formed.

The formation of the upper fillet of part 300 shown in FIG. 6 might also be accomplished with a continuous forming path such as forming path 304 where only small portions of the surface area of the part are formed with a larger number of incremental passes. The formation of the corners of part 300 might be accomplished using convoluted paths 306A, 306B, 306C and 306D. The formation of the sides of part 300 might be accomplished using a discontinuous forming path including a first contact segment 308A, a second non-contact segment 308B, a third contact segment 308C, a fourth non-contact segment 308D, a fifth contact segment 308E, a sixth non-contact segment 308F, a seventh contact segment 308G and a last, eighth, non-contact segment 308H. Segment 308A through 308H can be repeated in an incremental fashion down the sides of the part until the sides of the part are formed.

Figure 7:
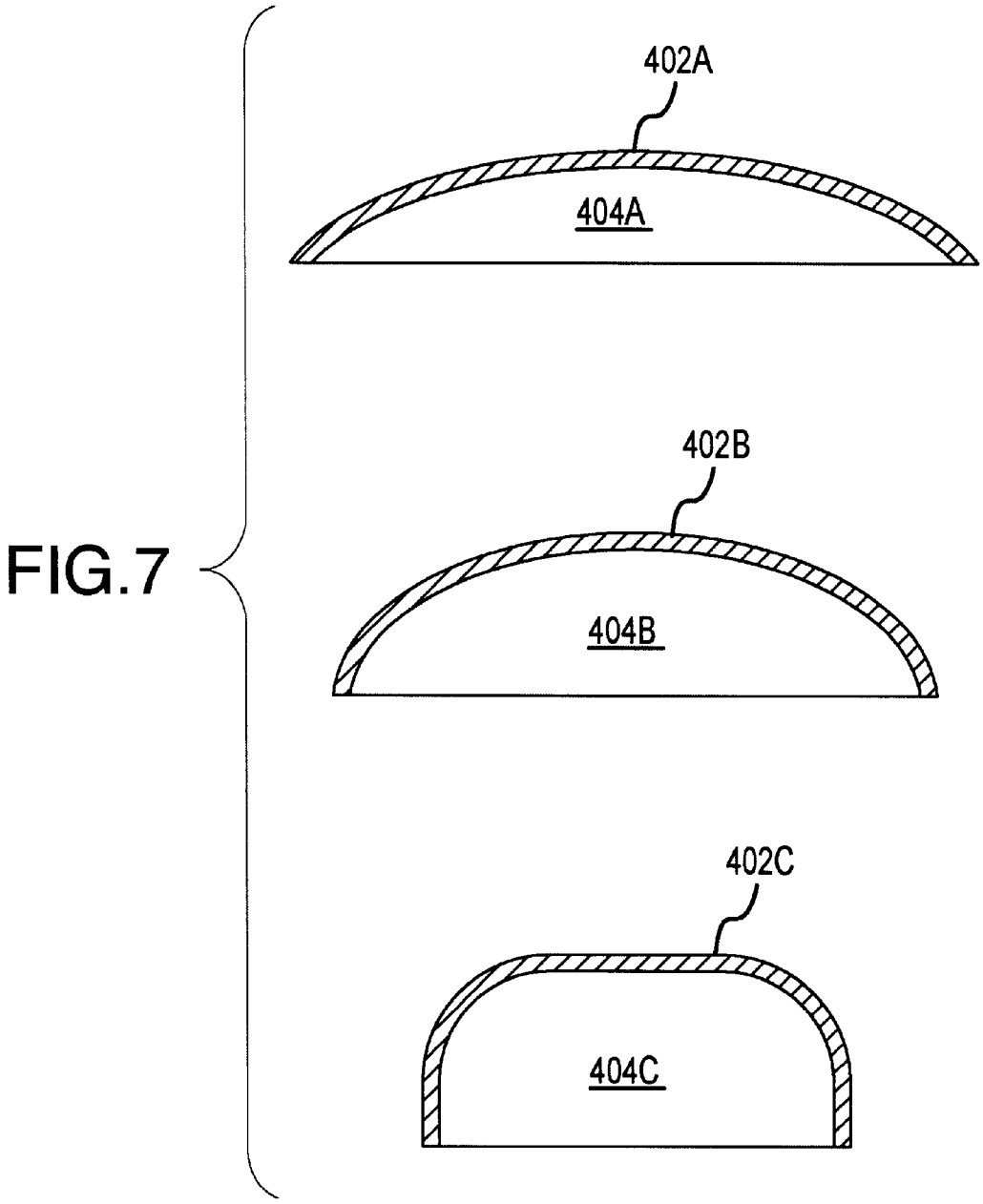
FIG. 7 is a sectional side view of three progressive steps used for forming a deeply contoured part.

Special finishing tools can be employed to finish fillets and corners. Forming tool 40C shown in FIG. 4C is an example of a finishing tool that would be used to finish the constant radius fillets of a part. Sometimes, it is difficult to form sheet materials into deeply contoured shapes. Accordingly, when using the present method to form deeply contoured shapes it may be necessary to use a series of dies and forming operations as shown in FIG. 7. In FIG. 7, a first stage metal part 402A is formed on a first die 404A. After part 402A has been annealed to relieve internal stresses, it is formed into part 402B on die 404B. After part 402B has been annealed a second time, it is formed into part 402C on die 404C. In this way, progressive forming operations can be used to form sheet metal into almost any complex contoured shape. By using a series of progressive dies as illustrated in FIG. 7 and by employing the various forming paths and the types of forming tools described above, it would be possible to form a very large variety of parts.

Figure 8:
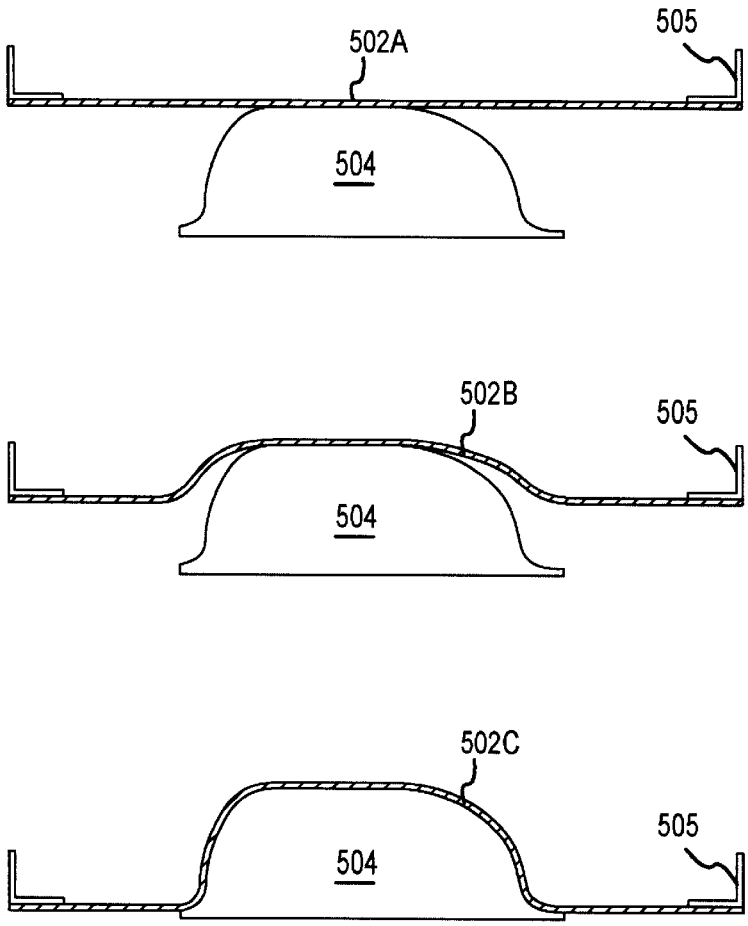
FIG. 8 is a sectional side view of a forming process having an intermediate forming step that is not supported by an intermediate forming die.

The inventor has also learned that a progressive forming operation can be performed as shown in FIG. 8 by using only one forming die. FIG. 8 is a cross section view of a two stage forming process that uses one forming die 504. Workpiece 502A in FIG. 8 is fixed in relation to forming die 504 and restrained at its edges by a frame 505. During a first forming operation, workpiece 502B is formed to an intermediate shape that is 50% of the depth of the final forming operation. The forming path for the intermediate shape can be determined by simply defining an intermediate surface in space that is halfway between the initial plane of workpiece 505A and the surface of forming die 504 and then establishing a forming path on the intermediate surface. This can be done by merely projecting points from the final forming surface of forming die 504 vertically by a distance that is 50% of the vertical distance to the initial plane of workpiece 502A.

FIG. 8 shows the use of frame 505. Frame 505 is not absolutely necessary in all instances where an intermediate shape is being formed in the absence of an intermediate forming die, however, frame 505 is useful for stabilizing the edges of the workpiece as it is being formed. Frame 505 can be a separate frame that is secured to the edges of workpiece 502A or it can be formed integrally from the edges of workpiece 502A by turning up the edges of workpiece 502A and fixing together the adjacent ends of those turned up edges.

The intermediate forming operation does not produce an exact shape. However, the shape produced by the intermediate forming operation is good enough to prepare the workpiece for the final forming operation. After the intermediate forming operation, workpiece 502B is formed in a final forming operation to 100% of the final shape. By using this process, a final shape is produced that is closer to the defined, desired shape.

All of the examples given above are illustrated using positive, convex dies. This was done merely for ease of illustration. The processes described above can be used with a negative or concave forming die. The surface of a forming die can therefore either have a convex, male or positive shape as in the above examples or a concave, female or negative shape or even have male portions and female portions in the same die. When a concave or negative forming die is used, the tangent area as described above would not be near the center of the part at the top of the forming die. Rather, when a concave or negative forming die is used, the tangent area would be distributed around the periphery of the part and around the outside of the forming surface and the forming die. Accordingly, a forming path for use with a concave or female forming tool would most likely begin adjacent to the tangent area at the outside of the forming tool and proceed inwardly toward the center of the forming tool until all of the surface has been traced.

The advantages of the invention forming method are best realized when the invention method is used to make a formed sheet part having a digital definition. A computer aided design digital data set that includes a three dimensional definition of a formed sheet part can provide the basic data needed to make that part using the invention forming method. The inside or outside surface of the formed sheet part as given by a three dimensional definition can provide the data needed to define the numerically controlled cutting paths needed for making a die. The three dimensional surface definition of the part that is opposite the surface used to define the die surface can provide the data needed to create a numerically defined forming path that describes the path of the contact surface of the forming tool. A numerically defined forming path can be used to create instructions for a numerically controlled multi-axis machine. A numerically controlled multi-axis machine could then be operated to manipulate a forming tool so that the contact surface of the forming tool follows the forming path or so that the center point of a forming tool follows a forming path that is offset from the workpiece surface.

Since the digital definition of formed sheet parts is now common, and since the numerically controlled machines are now plentiful, the invention method allows complex contoured formed sheet metal parts to be made without using hammer dies and hydro-presses or bag presses. Hammer dies and hydro-presses are expensive and are often beyond the reach of many manufacturing operations. They tend to be employed where large quantities of parts are required. Consequently, the invention method makes it possible to make such formed sheet metal parts where they previously could not be made and to make such parts in smaller quantities than would otherwise be economically feasible.

Obviously, in view of the numerous embodiments described above, numerous modifications and variations of the preferred embodiments disclosed herein are possible and will occur to those skilled in the art in view of this description. For example, many functions and advantages are described for the preferred embodiments, but in some uses of the invention, not all of these functions and advantages would be needed. Therefore, I contemplate the use of the invention using fewer than the complete set of noted functions and advantages. Moreover, several species and embodiments of the invention are disclosed herein, but not all are specifically claimed, although all are covered by generic claims. Nevertheless, it is my intention that each and every one of these species and embodiments, and the equivalents thereof, be encompassed and protected within the scope of the following claims, and no dedication to the public is intended by virtue of the lack of claims specific to any individual species. Accordingly, it is expressly to be understood that these modifications and variations, and the equivalents thereof, are to be considered within the spirit and scope of the invention as defined by the following claims, wherein, I claim.

I claim:

1. A forming method for forming material into a desired shape including an inside surface and an outside surface which is spaced from the inside surface by a desired wall thickness, the forming method comprising the following steps:

(a) fashioning a forming die having a surface that substantially matches the first surface of the shape, (b) defining a substantially continuous forming path that substantially follows the outside surface of the shape, the forming path beginning at a contact point in a tangent area suitable for initial contact between the material and the forming die and continuing by moving adjacent to the tangent area with circuits that are progressively spaced away from the tangent area until substantially all of the outside surface is traced, (c) orienting the forming path to match the forming die, (d) obtaining a forming tool, (e) holding the forming die in a substantially constant orientation, (f) holding the material against the forming die, (g) moving the forming tool in contact with the material such that the forming tool traces the forming path thereby forming the material into the desired shape.

2. The method of claim 1, wherein, at least two forming paths are defined for guiding the forming tool.

3. The method of claim 1, wherein, the forming path is replaced by a first forming path and a second forming path, wherein the first forming path is spaced away from the outside surface and the second forming path substantially matches the outside surface so that the material can be formed when the forming tool follows the first forming path and then formed a second time when the forming tool subsequently follows the second forming path.

4. The method of claim 1, wherein, at least a portion of the inside surface is generally concave, a corresponding portion of the outside surface is generally convex and a corresponding portion of the forming die is convex.

5. The method of claim 1, wherein, at least a portion of the inside surface is generally convex, a corresponding portion of the outside surface is generally concave and a corresponding portion of the forming die is concave.

6. A forming method for forming a feature in a thin walled material, the feature having a desired shape including an inside surface and an outside surface which is spaced from the inside surface by a desired wall thickness, the forming method comprising the following steps:

(a) fashioning a forming die having a surface that substantially matches the inside surface, (b) defining a substantially continuous forming path that substantially follows the outside surface, the forming path beginning at a contact point in a tangent area suitable for initial contact between the material and the forming die and continuing by moving adjacent to the tangent area with circuits that are progressively spaced away from the tangent area until substantially all of the outside surface is traced, (c) orienting the forming path to match the forming die, (d) obtaining a forming tool having a contact surface, (e) holding the forming die in a substantially constant orientation, (f) holding the material against the forming die, and, (g) moving the forming tool in contact with the material such that the forming tool traces the forming path thereby forming the material into the desired shape to make the feature.

7. The method of claim 6, wherein, at least two forming paths are defined for guiding the forming tool.

8. The method of claim 6, wherein, the forming path is replaced by a first forming path and a second forming path, wherein the first forming path is spaced away from the outside surface and the second forming path substantially matches the outside surface so that the material can be formed when the forming tool follows the first forming path and then formed a second time when the forming tool subsequently follows the second forming path.

9. The method of claim 6, wherein, at least a portion of the inside surface of the feature is generally concave, a corresponding portion of the outside surface of the feature is generally convex and a corresponding portion of the forming die is convex.

10. The method of claim 6, wherein, at least a portion of the inside surface of the feature is generally convex, a corresponding portion of the outside surface of the feature is generally concave and a corresponding portion of the forming die is concave.

* * * * *